US009648951B2

(12) United States Patent
Albrecht et al.

(10) Patent No.: US 9,648,951 B2
(45) Date of Patent: May 16, 2017

(54) DEVICE FOR MOVING A MOVABLE FURNITURE PART, AND ITEM OF FURNITURE

(71) Applicant: Grass GmbH, Hoechst (AT)

(72) Inventors: Markus Albrecht, Lustenau (AT); Tino Fellner, Hard (AT); Filip Rihtarec, Fussach (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/239,042

(22) Filed: Aug. 17, 2016

(65) Prior Publication Data

US 2017/0049235 A1 Feb. 23, 2017

(30) Foreign Application Priority Data

Aug. 21, 2015 (DE) ..... 20 2015 104 440 U

(51) Int. Cl.
*A47B 95/00* (2006.01)
*A47B 88/04* (2006.01)
(Continued)

(52) U.S. Cl.
CPC ..... *A47B 88/0477* (2013.01); *A47B 88/16* (2013.01); *E05B 63/22* (2013.01); *E05F 1/16* (2013.01); *E05Y 2900/20* (2013.01)

(58) Field of Classification Search
CPC ..... A47B 88/0477; A47B 88/16; E05F 15/00; E05F 15/16; E05Y 2900/20; E05B 63/22
See application file for complete search history.

(56) References Cited

U.S. PATENT DOCUMENTS

2006/0017358 A1* 1/2006 Sato ..... A47B 88/047 312/333
2006/0017359 A1* 1/2006 Sato ..... A47B 88/0477 312/333
(Continued)

FOREIGN PATENT DOCUMENTS

DE 24 19 116 A1 11/1975
DE 20 2011 004 477 U1 9/2014
(Continued)

OTHER PUBLICATIONS

German Search Report (Application No. 20 2015 104 440.2) dated Jun. 8, 2016.
(Continued)

*Primary Examiner* — Hanh V Tran
(74) *Attorney, Agent, or Firm* — Burr & Brown, PLLC

(57) ABSTRACT

A device for moving a movable furniture part, the device including a force accumulator such that by way of the fitted device the furniture part under the action of the force accumulator is capable of being put in the opening direction, and wherein the device has a locking assembly for locking a tensioned position of the force accumulator, in which the force accumulator is charged for the opening movement of the furniture part, wherein the tensioned position is unlockable. A locking member of the locking assembly, and a movable lever of the device, which is coupled to the force accumulator, are present in an interacting manner such that in the locked tensioned position of the force accumulator, the locking member assumes a locking position, and the lever assumes a standby position in which cancelling of the standby position of the lever is blocked by the locking member.

12 Claims, 12 Drawing Sheets

(51) Int. Cl.

| | |
|---|---|
| ***A47B 88/16*** | (2006.01) |
| ***E05F 1/16*** | (2006.01) |
| ***E05B 63/22*** | (2006.01) |

(56) References Cited

U.S. PATENT DOCUMENTS

| | | | | |
|---|---|---|---|---|
| 2008/0191592 | A1* | 8/2008 | Dubach | A47B 88/0477 312/319.1 |
| 2010/0026152 | A1* | 2/2010 | Huang | A47B 88/0477 312/319.1 |
| 2010/0320888 | A1* | 12/2010 | Koenig | A47B 88/0477 312/333 |
| 2011/0129172 | A1* | 6/2011 | Liang | A47B 88/0422 384/22 |
| 2013/0140970 | A1 | 6/2013 | Dubach | |
| 2014/0210329 | A1* | 7/2014 | Brunnmayr | A47B 88/0477 312/333 |
| 2015/0374125 | A1* | 12/2015 | Goetz | A47B 88/0481 312/319.1 |
| 2016/0007749 | A1 | 1/2016 | Brunnmayr | |
| 2016/0007750 | A1* | 1/2016 | Goetz | A47B 88/0481 312/319.1 |
| 2016/0135595 | A1 | 5/2016 | Erdel et al. | |

FOREIGN PATENT DOCUMENTS

| | | | |
|---|---|---|---|
| DE | 20 2013 005 797 | U1 | 9/2014 |
| ES | 2 535 477 | T3 | 5/2015 |
| WO | 2011/143682 | A1 | 11/2011 |
| WO | 2012/000657 | A2 | 1/2012 |
| WO | 2014/165874 | A1 | 10/2014 |
| WO | 2014/165876 | A1 | 10/2014 |

OTHER PUBLICATIONS

Extended European Search Report (Application No. 16183678.8) dated Jan. 12, 2017.

* cited by examiner

DEVICE FOR MOVING A MOVABLE FURNITURE PART, AND ITEM OF FURNITURE

This application claims the benefit under 35 USC §119 (a)-(d) of German Application No. 20 2015 104 440.2 filed Aug. 21, 2015, the entirety of which is incorporated herein by reference.

FIELD OF THE INVENTION

The present invention relates to a device for moving a movable furniture part, and an item of furniture.

BACKGROUND OF THE INVENTION

In the case of furniture parts such as, for example, drawers, furniture doors, or furniture flaps which are movably received on a basic furniture structure of an item of furniture via guide means, devices for influencing the movement of the furniture part are employed. Devices of this type are formed by a unit which is attachable to the furniture part, the basic furniture structure or the guide means at a suitable point, for example.

In particular, the guide means comprise a sliding guide such as a full pullout or a part pullout, or a pivoting guide such as a furniture hinge.

In the case of modern and user-friendly items of furniture, devices for moving the furniture part are known, for example, which may optionally be provided to provide an additional function, in particular, in order to facilitate the user in opening the furniture part. The additional function is, in particular, adaptable to the type and size of the furniture part. The device for influencing the movement of the furniture part relates to systems for providing a force-assisted opening function for the furniture part, for example.

SUMMARY OF THE INVENTION

It is an object of the present invention to advantageously provide an additional function for movement of a furniture part by means of a sliding guide, such as a full pullout or part pullout, or of a pivoting guide, in particular, so as to provide a functionally reliable operationally ready position and actuation of a force-assisted opening movement of the furniture part on a first part distance of the opening path.

The present invention proceeds from a device for moving a movable furniture part in an opening direction of the furniture part in relation to a basic furniture structure of an item of furniture, wherein the movable furniture part by way of guide means is capable of being put in the opening direction and in a closing direction which is counter to the opening direction, wherein the device comprises a force accumulator such that by way of the fitted device the movable furniture part under action of the force accumulator is capable of being put in the opening direction, and wherein the device has a locking assembly for locking a tensioned position of the force accumulator, in which the force accumulator is charged for the opening movement of the furniture part, wherein the tensioned position is unlockable. The present invention relates, in particular, to a furniture-part opening device.

The core concept of the present invention lies in that a locking member of the locking assembly, and a movable lever of the device, which is coupled to the force accumulator, are present in an interacting manner such that in the locked tensioned position of the force accumulator, the locking member assumes a locking position, and the lever assumes a standby position in which cancelling of the standby position of the lever is blocked by the locking member. Reliable and functionally precise locking and unlocking which is repeatable multiple times in an identical manner is thus advantageously guaranteed. Moreover, locking and unlocking which is low in noise and friction is possible by way of the present invention.

In particular, a comparatively short unlocking path of the unlocking member for cancelling the locking mechanism, or from the locked position to the unlocked position, respectively, is advantageously provided. Cancelling of the locking mechanism typically requires action by the user from the outside, for example, as an actuation action or an unlocking action, respectively.

Preferably, the device according to the present invention for actuating the unlocking procedure from the outside has a so-called touch-latch function or a touch-latch assembly, respectively. In the case of an integrated touch-latch function, the furniture part, which is held so as to be closed on the basic furniture structure so as to be typically in the closing position, is moved along a comparatively short movement path of the furniture part by moving the furniture part in the closing direction, this describing the unlocking procedure. The unlocking procedure is a precondition for the opening movement, force-assisted by the force accumulator, of the furniture part to be performed.

Moving the furniture part for actuation is performed from the outside by the user who pushes against a front of the furniture part, for example.

Herein, an actuator element of the device which interacts with the locking member is moved in a linear or translational manner, for example, the locking mechanism thus being capable of being cancelled by readjusting the locking member. The linear actuation path of the furniture part and thus of the actuator element is advantageously reduced by the invention to a comparatively short actuation distance of a few millimeters, for example. The device is advantageously distinguished by high reliability of the locking mechanism and of the actuation mechanism.

Upon having depressed the furniture part, that is to say, once the user no longer acts on the furniture part, whereby unlocking is completed, the furniture part under the action of the charged or tensioned force accumulator, respectively, is moved from the closed position on the basic furniture structure in the opening direction. The outward movement of the furniture part, such as a drawer, for example, in relation to the basic furniture structure is performed under action of the force accumulator at least across a partial distance of a maximum opening path of the furniture part that according to the guide means is provided on the basic structure.

The device according to the present invention is preferably designed such that the force accumulator which during opening is partially discharged is recharged, or is capable of being returned to the tensioned state, respectively, by way of a closing movement of the furniture part in relation to the basic furniture structure. The effort in force required to this end is applied by the user when the user pushes the furniture part in the closing direction. After completion of the tensioning procedure, with the locking member being in the locking position, an automatic retraction feature which is integrated in the guide means, for example, may advantageously move the furniture part by a few centimeters, for example, to the completely closed position on the basic furniture structure. The closed furniture part then awaits the next actuation procedure.

In particular, the lever may be a coupling element of a coupling installation which is present between the force accumulator and an ejector component. The ejector component is repositionable on the device under the action of the force accumulator, the furniture part thus being capable of being put from the closing position in the opening direction. The coupling installation is effective when the user closes the furniture part and the ejector component herein is repositionable with the aid of the coupling installation, the force accumulator thus being put in the tensioned position.

The lever is movably, preferably pivotably, mounted on the device, wherein the lever by way of the at least substantial relaxing procedure of the force accumulator during opening of the furniture part carries out a movement.

In the tensioned state of the force accumulator, the locked lever is in the rest position which is blocked by the locking member. The standby position describes an initial pivoted position for the next opening procedure. The lever is blocked in that direction in which the lever moves once unlocking has taken place.

Accordingly, blocking prevents the lever from moving in a relaxing direction.

In order for the locked or blocked lever, respectively, to be ready in a defined or durable manner, respectively, for the furniture part to be opened, the lever under the action of the charged force accumulator is biased in the relaxing direction. In this direction, the locking member forms a mechanical stop for the lever. The lever is preferably coupled in terms of motion to the force accumulator in such a manner that the position of the moving or pivoting lever, respectively, in a pivoting direction is continuously modified when the force accumulator during opening of the furniture part is discharged from the tensioned state, said force accumulator continuously pivoting back in the other pivoting direction when the force accumulator is being tensioned again.

The locking member is preferably positioned such that the locking member in the locking state obstructs the movement path of the lever. By cancelling the locking mechanism, the movement path of the lever is unblocked, and the lever pivots past the locking member which is being moved away.

Advantageously, the lever has a contact portion which in the standby position of the lever assumes a blocked state and comes to bear on the locking member, respectively. The contact portion is preferably received in a readjustable manner on the lever, in particular, is capable of being reversible from a projecting position to a sunken position on said lever. In particular, the lever is capable of being brought into contact with the locking member exclusively by way of the contact portion. Preferably, the contact portion is present so as to be biased on the lever, preferably so as to be biased in the direction of a projecting state on the lever. Biasing is implemented by way of a spring, for example. The spring urges the contact portion to a position in which the contact portion and thus the lever is blocked on the locking member. In the locking position of the lever on the locking member the contact portion is brought under bias to the bearing position on the locking member.

In particular, the contact portion is present on a portion of the lever which is remote by a substantial length of the lever from a mounting or pivot axis of the lever.

In the locking state, the contact portion bears in a planar manner on the locking member. In this way, pivoting the locking member away from the contact portion is possible at low noise and without interference, despite secure blocking. Preferably, a mutually hooked state between the contact portion and the locking member is avoided by the invention, the former under certain circumstances being potentially more prone to malfunctioning in terms of establishing and/or releasing the locking state.

It is advantageous, in particular, that the locking member is movably, in particular, pivotably, mounted. The locking member may advantageously be capable of being put in the locking state and out of the latter in a movable or pivotable manner, respectively. In particular, only a minor actuation path of an actuator element is required in order for the locking mechanism to be reliably cancelled by way of a minor pivoted path of the locking member. Preferably, the locking member is pivotable about an axis which is aligned so as to be transverse to the pivot axis of the lever.

It is furthermore of advantage for the locking member to be biased. In particular, the locking member for unlocking is capable of yielding in relation to the bias. The locking member is biased in the direction of the locking position thereof, or in the locking position thereof, respectively. In this manner, the locking position under the action of the bias is advantageously capable of being reliably established and controllably cancelled again. Following cancellation of the locking mechanism, the locking member under the bias automatically returns to the locking position if and when no counterforce to the bias is effective.

During unlocking, the locking member is deflected counter to the action of the bias, to which end a cancelling force from the outside is required. This force is applied by the user during actuation. As soon as the user relents, the locking member is urged back to the locking position. A spring, preferably a leaf spring, may be considered as the biasing element for the locking member.

Moreover, it is advantageous that the contact portion is mounted so as to be capable of yielding from the blocked state. In particular, tensioning of the force accumulator may be advantageously performed by way of yielding in relation to the lever. Advantageously, the contact portion is repositioned by way of relaxing and maintained up to the end of the tensioning procedure such that no force has to be applied during tensioning, the latter being advantageous for the tensioning procedure since a comparatively high force has to be applied anyway by the user for tensioning, or since no further force is required for pushing back the contact portion, respectively.

The contact portion is preferably impinged by a spring, for example, by a leg spring.

In particular, it is advantageous that in the case of the locking mechanism being established, the locking member may remain in the locking position thereof, malfunctioning by virtue of movement of the locking member thus being precluded or minimized, respectively, in the comparatively critical phase in the moment of the locking mechanism being established. This is because the locking member does not have to be readjusted since the former is already located in the locking position. It is only in the case of the actuation procedure that the locking member is briefly moved out of the locking state and immediately thereafter is returned to the locking stated. Herein, the locking member even at the end of the tensioning procedure remains in the locking position and does not have to depart therefrom in order for the contact portion to pass by to reach the blocked position. Rather, according to the present invention, the contact portion yields from the blocked state and, after bypassing the resting locking member, reaches the blocked position in a biased manner.

Resetting of the comparatively small and light contact portion to the blocked state herein is not critical.

The contact portion in the tensioning procedure of the force accumulator on the locking member yields to a position which on the lever is not protruding or less protruding, respectively, this arising only shortly before the locking state is reached, the lever thus passing by the locking member. After passing by the locking member, the contact portion by way of the bias immediately and automatically returns to the blocked state and is blocked on the locking member. This is performed without any pressure since, by way of the momentum at the end of the tensioning procedure, the lever pivots somewhat farther in the tensioning direction past the locking member, the contact portion thus being able to reliably reach the projecting position before the lever, after the tensioning force has receded, by way of the protruding contact portion impacts on the locking member and is blocked.

Accordingly, the contact portion is biased in the direction of the blocked state, or is biased toward an outwardly pivoted position in relation to the lever, respectively.

One advantageous modification of the present invention is distinguished in that the contact portion is designed on a pivotable latch. This is a particularly compact and reliable construction principle. The latch is inwardly pivotable counter to a spring action. The contact portion is preferably designed in a planar manner, for example, is formed by a component periphery.

According to one advantageous variant of the present invention, the locking member and the lever are adapted in such a manner that a departure from the locking position of the locking member is a precondition to the standby position of the lever being capable of being cancelled. In order to depart from the locking position, a minor movement of the locking member from the resting locking position is advantageously already sufficient. The minor movement may, in particular, be a minor pivoting movement by a few angular degrees about the pivot axis of the locking member. The blockage of the lever is cancelled by way of the movement. The locking member resets itself to the locking position when the lever or the contact portion on the locking member, respectively, loses contact.

It is moreover advantageous that the locking member and a support portion on the lever are adapted in such a manner that upon departing from the locking position of the locking member, the support portion acts on the locking member, wherein the locking member moves away from the locking position. In the case of actuation, the locking member by way of the support portion is advantageously moved onward by an additional movement path in the direction in which the locking member is further removed from the locking position.

In particular, in departing from the locking position, the locking member by way of the support portion is moved away or pivoted away, respectively, without a change of direction by the additional movement path or by further angular degrees from the locking position.

Onward movement of the locking member is, in particular, performed by way of the lever movement in the case of the relaxation of the force accumulator following unlocking. The displaceable support portion on the lever may or may not be movable in relation to the lever.

It is also advantageous that the contact portion and the support portion are designed on a common component on the lever. In particular, this is a pivotable latch on a lever, such as, for example, a guide lever, or on a lever attachment, respectively, of a guide lever. The movement of the locking member, in particular, along a predefinable movement path is enlarged in a preferably force-controlled manner by way of the support portion which becomes effective immediately after that movement of the locking member that is required for unlocking the locking member.

This expansion of movement is advantageous with a view to a transmission of a movement from the locking member to another element, such as an element of a functional unit, for example. This functional unit is a unit which is separate from the device and is present so as to be spaced apart therefrom. It is often required that a synchronous and complete transmission of the movement of the locking member, in particular, in relation to the unlocking procedure, is transmitted to the element of the functional unit. To this end, it must be ensured that the movement of the locking member in relation to the required movement of the locking member which is sufficient for unlocking is enlarged. This is because a proportion of movement is lost during transmission by way of the transmission of movement via a connection element, for example. The transmission of movement is preferably implemented by way of the connection element which physically connects the locking member to the element.

In order for a movement to be received by the element of the functional unit in the magnitude which is required for the element, the proportional loss on the connection path by way of the connection element has to be considered. The proportional loss is caused by material properties and/or component tolerances. Therefore, the movement of the locking member in the case of the unlocking procedure must be enlarged such that this enlarged movement may be received by the connection element and said enlarged movement may be transmittable to the element of the functional unit. There, a movement which is sufficient, or at least corresponds to the magnitude of the movement of the locking member which the latter carries out by way of the support portion without enlargement, respectively, is received.

One advantageous variant of the present invention is characterized in that the locking member and the lever are mutually adapted such that the lever in the case of the force accumulator being tensioned is movable past the locking member, wherein the lever is capable of being put in the standby position. The locking position may thus be established immediately and reliably. In particular, the contact portion during tensioning, or optionally the latch by bearing on the locking member on the lever, respectively, yields. By way of the bias of the latch, the latter automatically returns to the preceding position on the lever as soon as the lever has been moved past the locking member. The contact portion in the standby position of the lever is thus brought to bear on the locking member. The lever, in terms of the action of the tensioned force accumulator, by way of the locking member bearing thereon, is blocked in the respective unlocking direction.

Moreover, the present invention extends to an item of furniture having a basic furniture structure and a movable furniture part which by way of guide means in relation to the basic furniture structure is movable in an opening direction of the furniture part and in a closing direction which is counter to the opening direction, wherein a device as has been explained above is provided. The above-mentioned advantages may thus be established on an item of furniture, in particular, on an item of furniture having a drawer or a flap or a door. This is advantageous, in particular, in the case of items of furniture which in a guide or in a full pullout, respectively, have an automatic retraction feature by way of which the furniture part is retractable to the fully closed closing position on the item of furniture.

Moreover, the item of furniture has a device as has been explained, and a twin device, wherein a touch-latch function in both devices is synchronized by way of a synchronization feature. For example, reliable actuation of the locking position of the locking member may thus be established independently of where the force is applied to the furniture part. For example, when a device according to the invention is present in the region of guide means which are fitted on the right side on the furniture part, and a twin device is present in the region of guide means which are fitted on the left side on the furniture part, the locking member of the right-hand device may be reliably actuated by the user acting on the furniture part, close to the right-side device. By way of the synchronization feature, the locking member of the left-side twin device is then also reliably and synchronously actuated or unlocked, respectively.

BRIEF DESCRIPTION OF THE DRAWINGS

Further features and advantages of the present invention are explained in more detail by means of exemplary embodiments which are schematically illustrated in the figures.

DETAILED DESCRIPTION OF THE INVENTION

Figure 1:
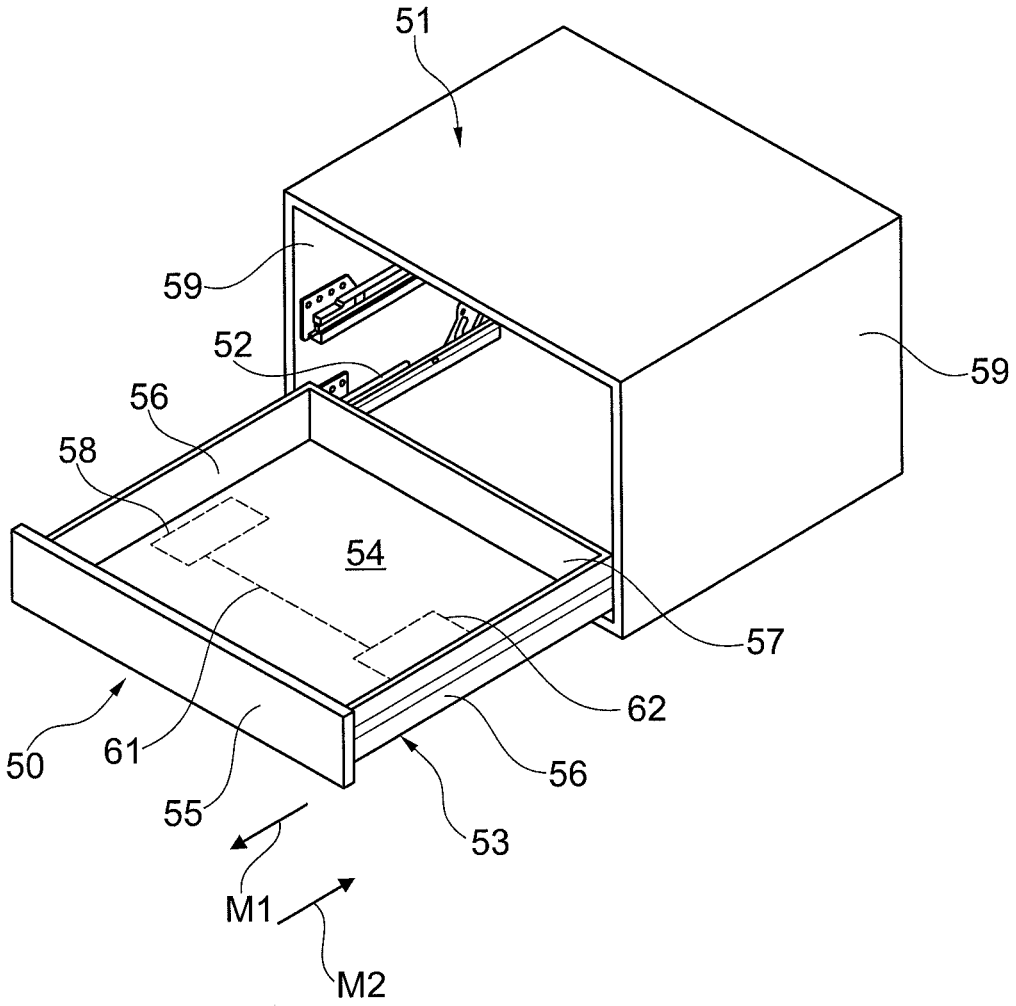
FIG. 1 shows an item of furniture according to the present invention in a perspective view from obliquely above, having a drawer in a completely opened state on a basic furniture structure.

An item of furniture 50 according to the present invention, having a box-shaped basic furniture structure 51 and a drawer 53 which by way of guide means 52 is movably guided, is illustrated in FIG. 1. The drawer 53 comprises a drawer base 54, a drawer front 55, two mutually opposite side walls 56, and a rear drawer wall 57. Two guide means 52 with identical action for guiding the drawer 53 are present in each case between each side wall 56 of the drawer 53 and an associated basic-structure side wall 59. A device 58 according to the present invention (illustrated with dashed lines), for moving or ejecting, respectively, the furniture part which is configured as a drawer 53 in the opening direction M1 is disposed on a lower side of the drawer base 54.

Figure 2:
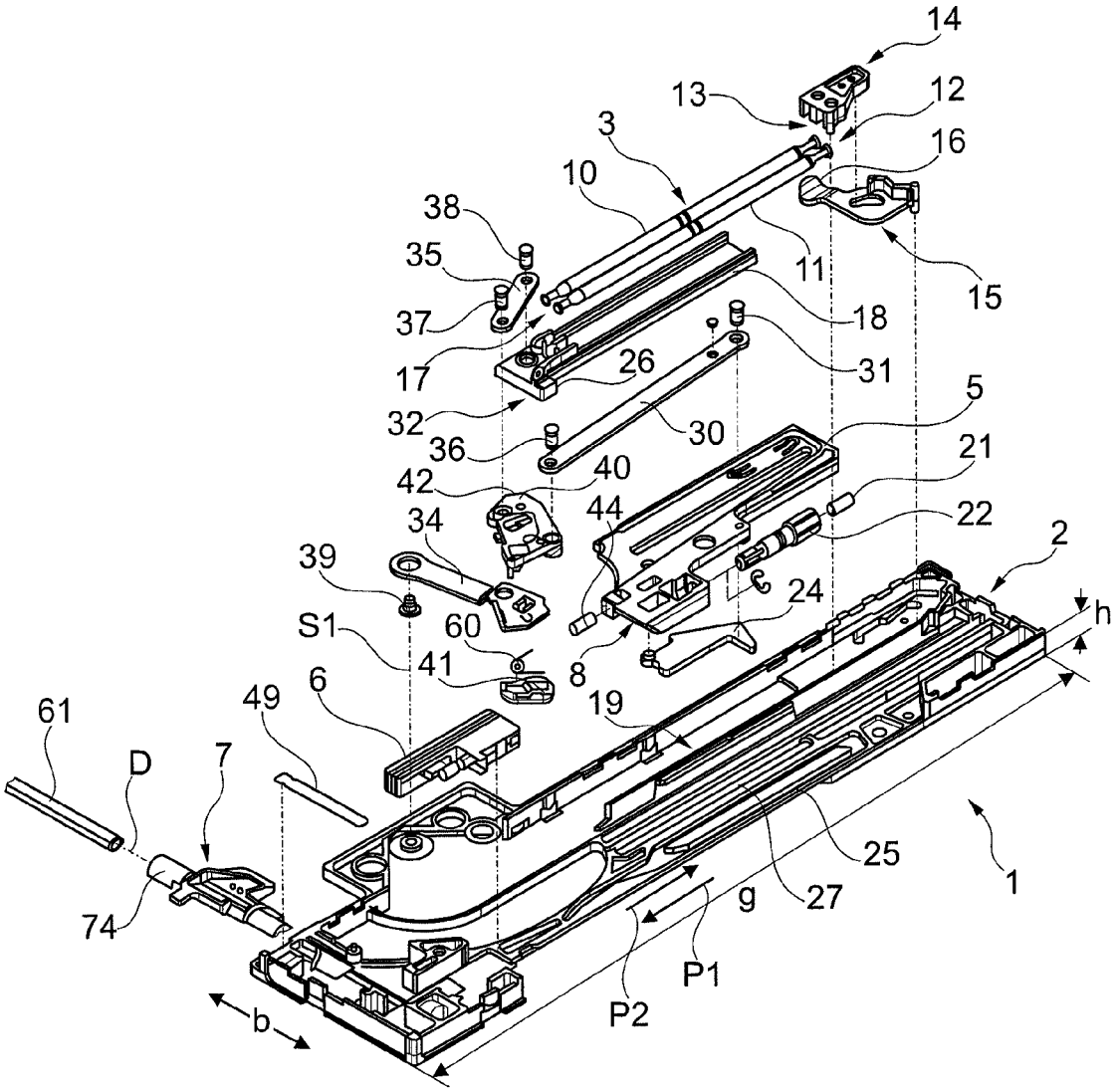
FIG. 2 shows a device according to the present invention, without a cover component, in an exploded illustration.

FIG. 2 shows the exploded illustration of the device 58 which is configured as an ejector unit 1 for the drawer 53.

The ejector unit 1 serves for the force-assisted ejection of the drawer 53 across a first part-distance of the opening movement of the drawer 53 in relation to the basic furniture structure 51, from a closed position in the opening direction M1 of the drawer 53.

The drawer 53 by way of the guide means 52, for example, two identical part-pullout units or full-pullout units, is mounted on the basic furniture structure 51 so as to be displaceable in the directions M1 and M2.

Alternatively, the ejector unit 1 may be disposed on the basic furniture structure 51 or on the guide means 52 of the item of furniture 50.

The ejector unit 1 comprises inter alia a base plate 2, a force accumulator 3, a coupling installation 4, an ejector 5, an activation element which is configured as an activator 6, and a locking member 7.

Figure 9:
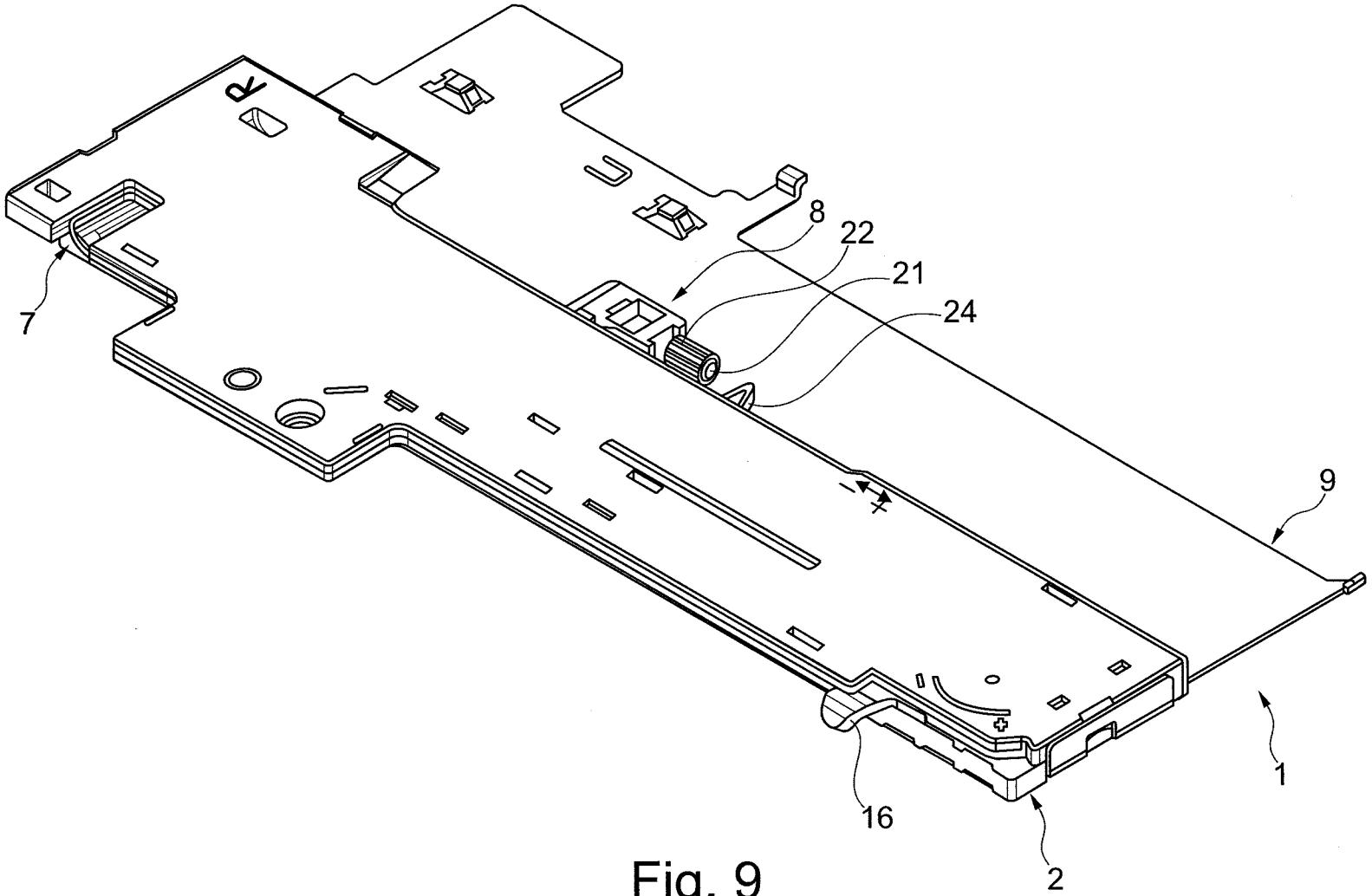
FIG. 9 shows the device according to FIG. 5, having a cover component, in a perspective view from obliquely below toward a second main side of the device.

A housing of the ejector unit 1 comprises the base plate 2 and a cover component 9 which is visible in FIG. 9. The ejector unit 1 may be disposed on the lower side of the drawer base 54 and/or on the guide means 52 by way of the housing or by way of the cover component 9 and/or the base plate 2, respectively.

Retaining portions, guide contours, stop members, and/or receptacle portions for linking the individual components of the ejector unit 1 are configured on the base plate 2. The base plate 2 is designed substantially as a rectangular, elongate or strip-shaped component, having a comparatively minor height h of approx. 5 to 15 millimeters, for example. The base plate 2 furthermore has a width b of approx. 4 to 10 centimeters, and a length g.

According to the exemplary embodiment shown, the force accumulator 3 comprises two identical coil springs 10, 11 which configure a spring pack and which are disposed in parallel. At a first end 12 of the force accumulator 3, the coil springs 10, 11 are disposed on an adjustable fixed mounting 13. The fixed mounting 13 comprises a movable mounting part 14 on which the coil springs 10, 11 are received in a releasable yet fixed manner, and a set part 15 having an operating portion 16 by way of which a user may adjust from the outside a position of the end 12 of the force accumulator 3 in a modifiable and positionally fixed manner. On account thereof, an effect of force of the force accumulator 3 on the drawer 53 may advantageously be pre-adjusted in the case of the opening procedure of the drawer 53.

The associated ends of the coil springs 10, 11 are fastened to a slide-type motion element 18 at a second end 17 of the force accumulator 3. The slide-type motion element 18 by way of an associated guide contour 19 is linearly guided on the base plate 2 so as to be movable in a movement direction P1 and in an opposite movement direction P2.

The movement directions P1 and P2 of the motion element 18 (cf. FIGS. 2 and 3) run parallel with the opening direction M1 of the drawer 53 and with a closing direction M2 which is counter thereto.

If and when the ejector unit 1 is disposed in a positionally fixed manner on the basic furniture structure 51 and/or on a stationary part of the guide means 52, the opening direction of the drawer 53 corresponds to the direction P1, and the closing direction of the drawer 53 corresponds to the direction P2.

Herebelow, an assembled state of the ejector unit 1 on the drawer base 54 is assumed.

Figure 3:
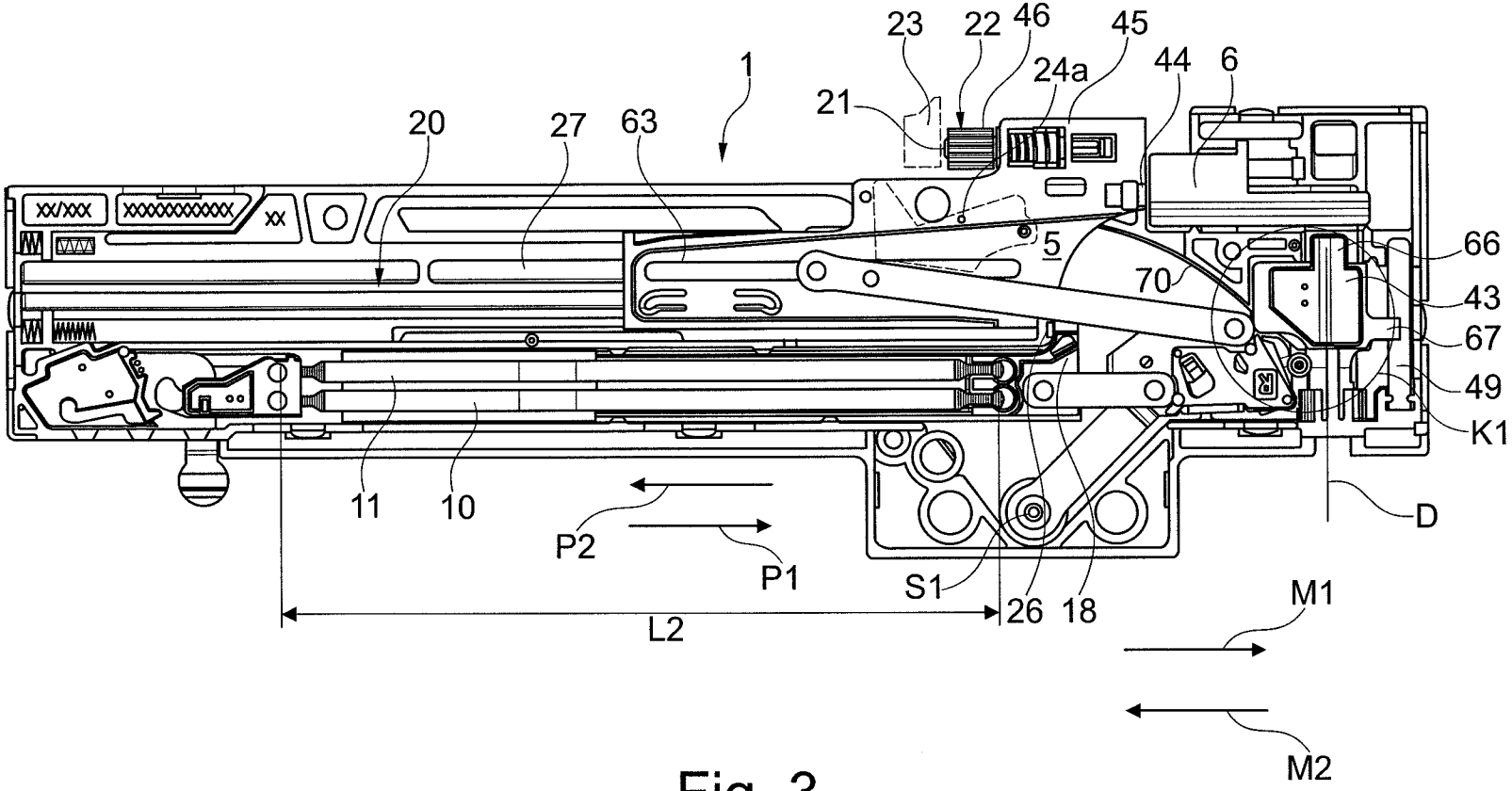
FIGS. 3 to 8 show the device according to FIG. 2, in an assembled state, in a plan view of a first main side, in various operational states.
Figure 7:
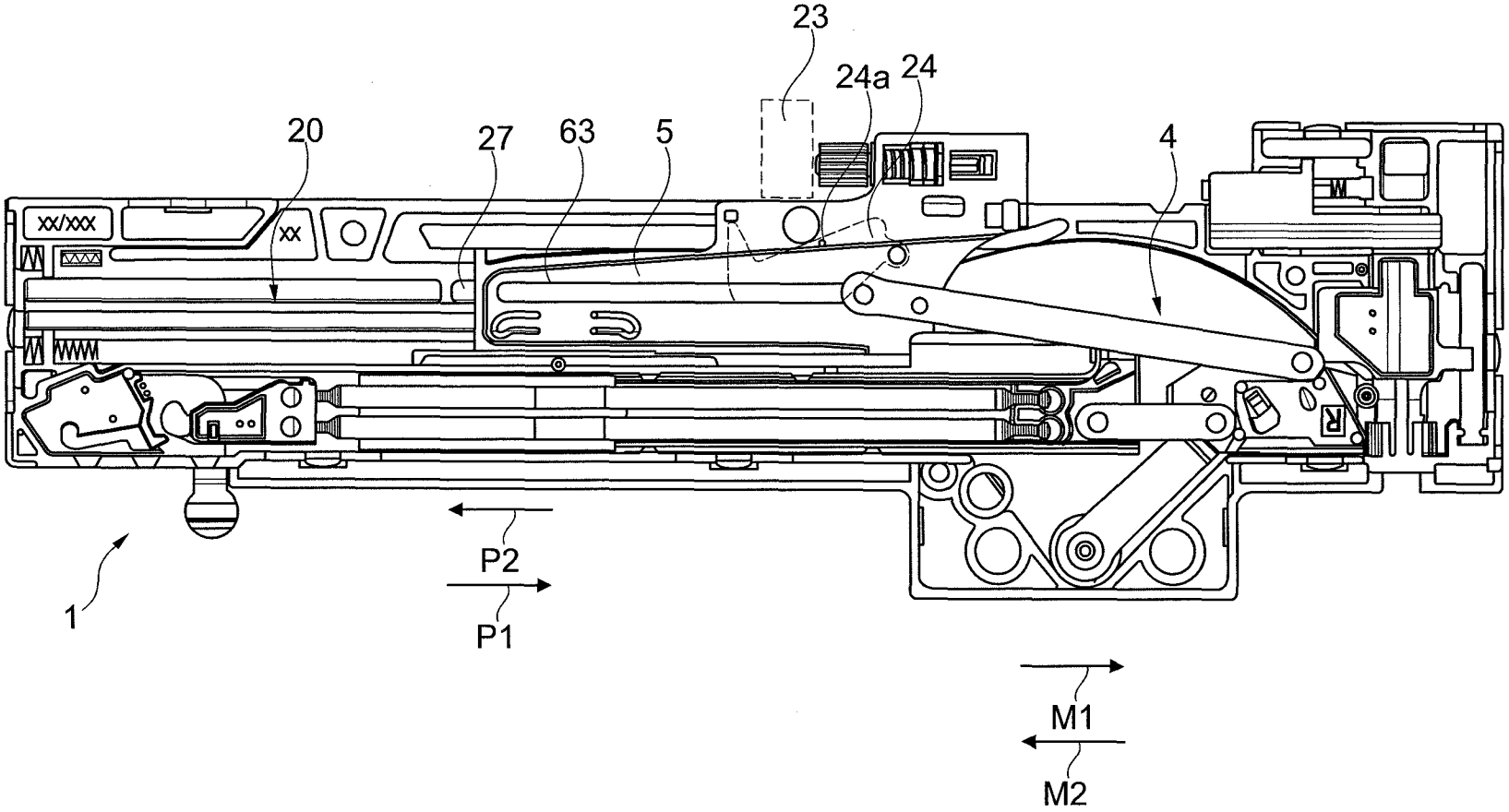
Figure 8:
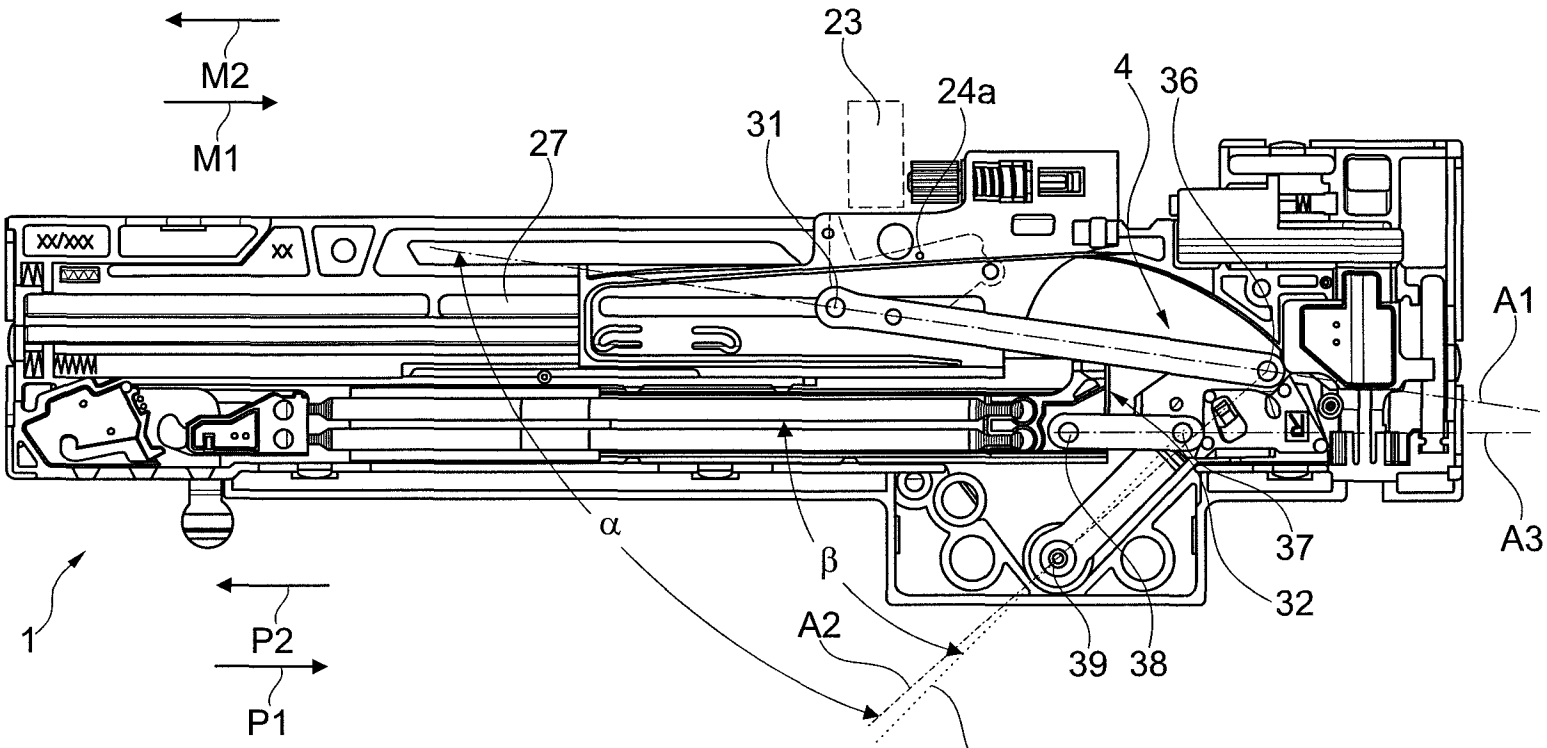

FIGS. 3, 7 and 8 show the ejector unit 1 in a tensioned state of the force accumulator 3, in which the coil springs 10, 11 are elongated or are tensioned so as to be under a tensile load, respectively; herein, the motion element 18 in relation to a retracted position in the direction P2 is offset on the base plate 2 in the direction P1 and is retained in a tensioned position.

Figure 5:
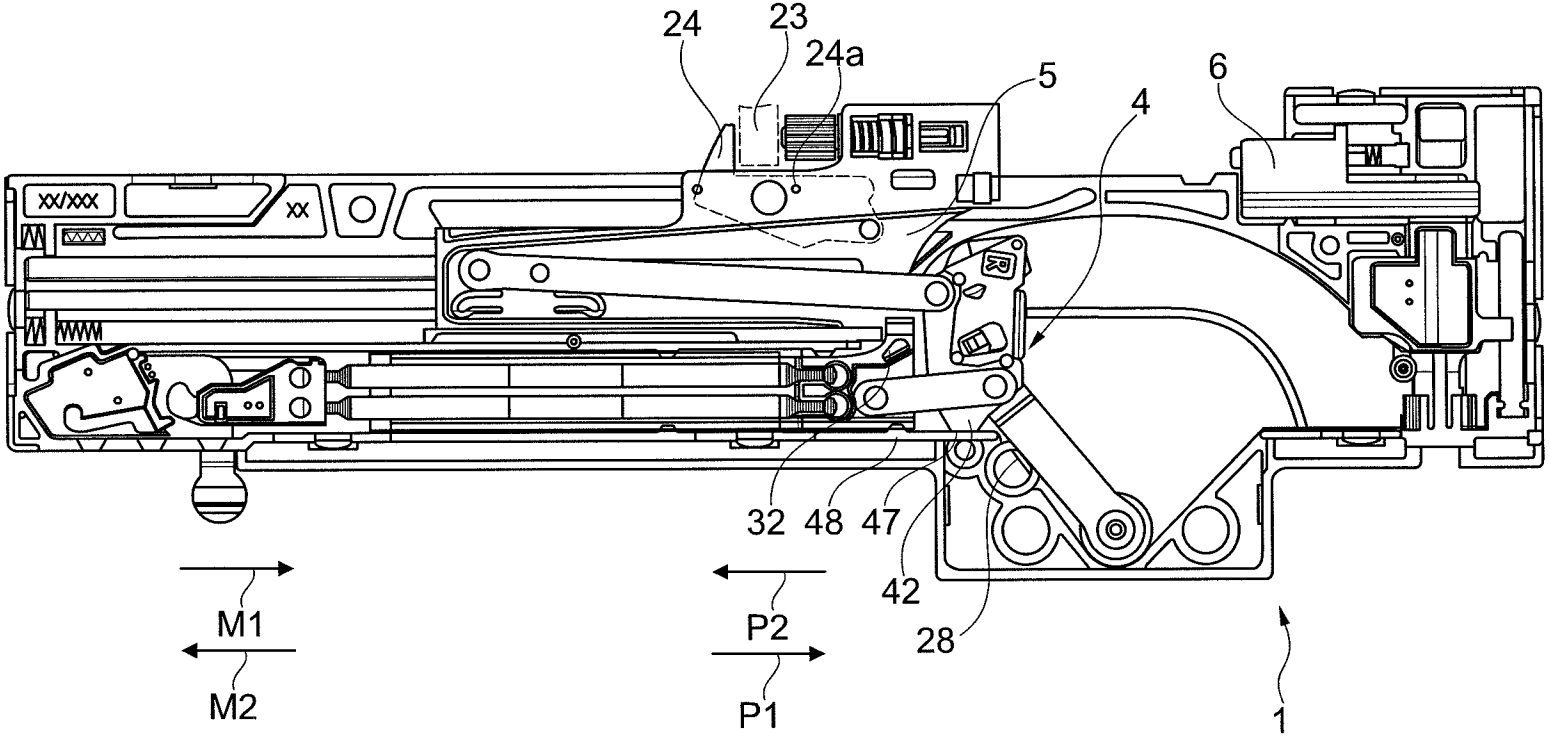
Figure 6:
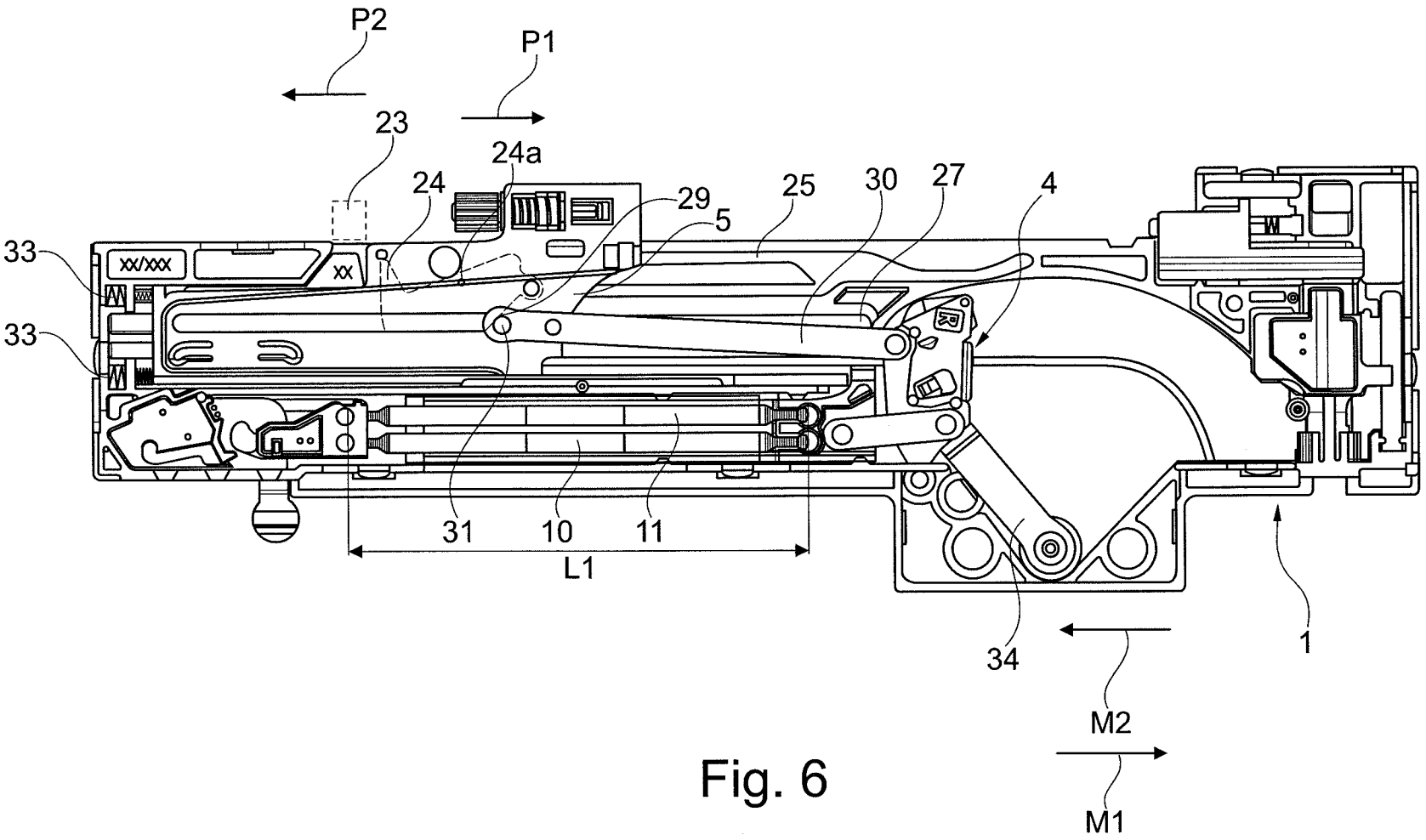

FIGS. 5 and 6 show the ejector unit 1 in a discharged basic state of the force accumulator 3, in which the coil springs 10, 11 are furthermore biased under a tensile load but to a lesser degree, and have a length L1.

In the tensioned state of the force accumulator 3 the coil springs 10, 11 have a length L2 which is greater than L1.

A retaining member 32 having a stop element 26 is present on the motion element 18. The stop element 26 in the case of a force-assisted opening procedure is in contact with an ejector 5.

By way of a coupling installation 4, the force accumulator 3 or the motion element 18, respectively, is operationally connected to the ejector 5, preferably exclusively in the case of the closing procedure of the drawer 53. The ejector 5 is movable to and fro in the directions P1 and P2, in particular, exclusively movable in a linear manner, or so as to be parallel with the movement direction of the motion element 18, respectively. To this end, a linear guide 20 which is adapted to guide portions, for example, on one side of the ejector 5, is configured on the base plate 2.

Figure 4:
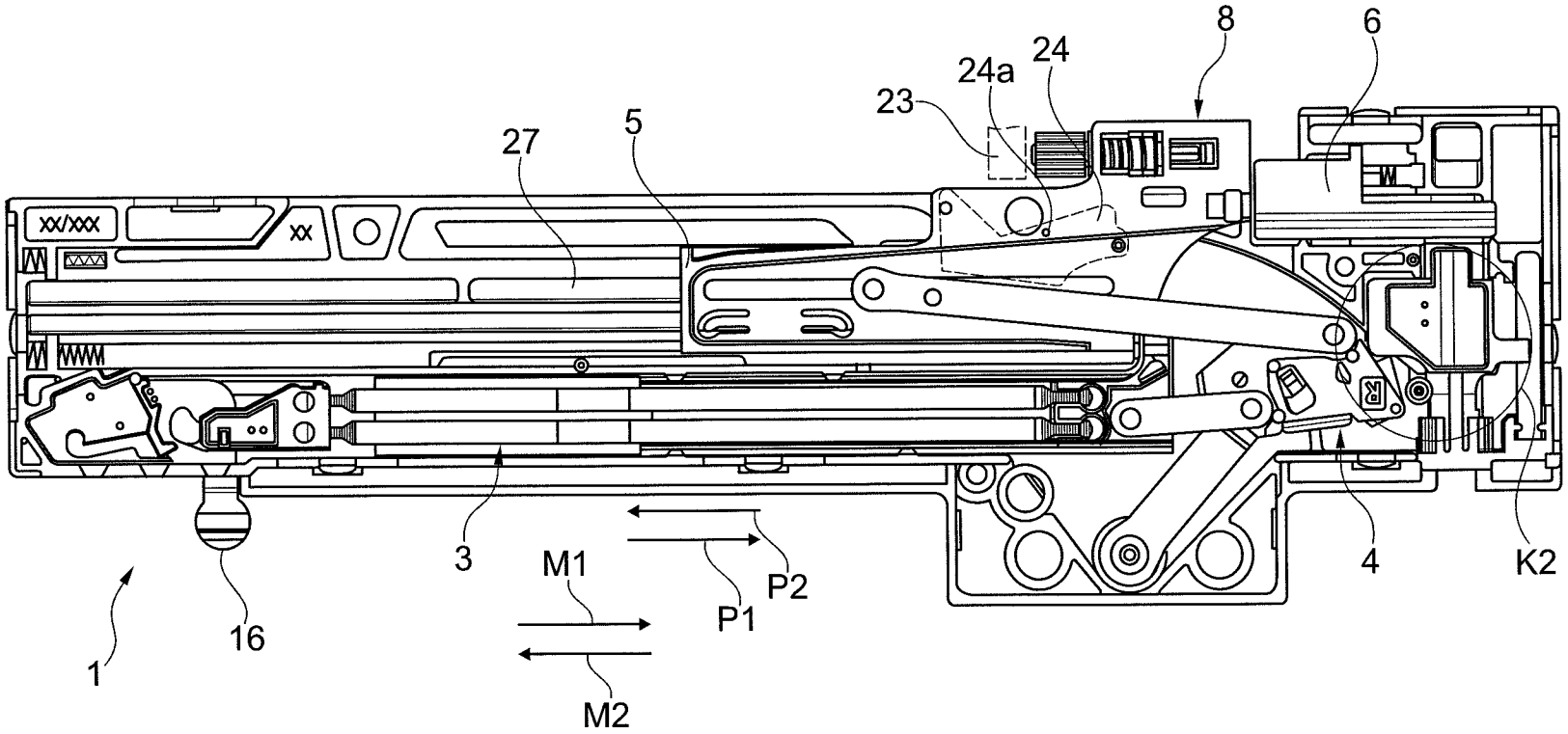

An opening procedure of the drawer 53, caused by the ejector unit 1, takes place exclusively by way of a direct operational connection of the force accumulator 3 to the ejector 5, by way of the motion element 18 which moves in the direction P2. To this end, a stop element 26 which is advantageously designed so as to be elastic and thus prevents or at least dampens any sound which is disturbing to a user when the motion element 18 impacts the ejector 5 in the opening procedure of the drawer 53 is configured on the motion element 18 (FIGS. 3, 4 and 5).

A front-gap adjustment assembly 8 which is configured on the ejector 5 comprises a housing 45 and a set screw 22 having a contact portion 21. The set screw 22 has an external thread which interacts with an internal thread on the housing 45. Depending on the rotation direction, a position of the contact portion 21 of the set screw 22 is adjustable in the direction P1 or P2 by manual rotation of an operating portion 46 of the set screw 22 by a user. In particular, the set screw 22 is configured so as to be self-locking in relation to the housing 45. A measure of a front gap between the drawer front 55 of the drawer 53, which is closed on the basic furniture structure 51, and end sides of the basic furniture structure 51 is capable of being predefined by way of the predefined position of the set screw 22.

The contact portion 21 of the set screw 22 in the tensioned or charged state, respectively, of the force accumulator 3 bears on an entrainment element 23 which in respective operational states forms a stop for the contact portion 21. The entrainment element 23 which in FIGS. 3 to 8 is merely indicated by dashed lines may be present on a fixed rail of the guide means 52, for example, or be attached to the basic furniture structure 51 when the ejector unit 1 is disposed on the drawer 53.

However, if and when the ejector unit 1 is disposed on the basic furniture structure 51 or on a positionally fixed part of the guide means 52 of the item of furniture 50, the entrainment element 23 may be present on the drawer 53 and thus be movable in relation to the basic furniture structure 51.

If and when, proceeding from the basic position of the ejector unit 1 according to FIG. 3, a locking feature is cancelled on the ejector unit 1, as is shown in FIG. 4 and will be explained in more detail below, the tensioned or charged force accumulator 3, respectively, pulls the motion element 18 in the direction P2, the latter by way of the stop element 26 urging or sliding, respectively, the ejector 5 in relation to the base plate 2 in the direction P2.

As soon as the ejector 5 on the base plate 2 moves in the direction P2, a latch component 24 of the ejector unit 1, which is pivotably mounted on the ejector 5, is put from an inwardly pivoted position according to FIG. 4, in which said latch component 24 in relation to an external periphery of the base plate 2 is completely retracted, to an outwardly pivoted position in which said latch component 24 by way of a lug partially projects beyond the external periphery of the base plate 2 (FIG. 5), this being implemented by way of a loop-shaped closed guide track 25 in the base plate 2 and by way of a guide pin 24*a*, engaging in said guide track 25, on the latch component 24.

In order for the latch component 24 to be illustrated, the outline thereof which is obscured by other components, in particular, by the ejector 5, in FIGS. 3 to 8 is indicated with dashed lines.

In the basic state which is illustrated in FIG. 5, the force accumulator 3 is located in a terminal position of the discharged state, wherein the force accumulator 3 is unable to move the ejector 5 any farther in the direction P2.

By virtue of the kinetic energy of the drawer 53, caused by the preceding ejection movement, and/or by manually moving the drawer 53 farther in the opening direction M1 by a user, the ejector 5 is subsequently displaced in relation to the base plate 2 in the direction P2. This is possible because the latch component 24 which has been outwardly pivoted so as to project from the ejector 5 bears on the entrainment element 23, the ejector 5 in the further course of the movement of the drawer thus reaching the terminal position thereof which is displaced to a maximum in the direction P2 on the base plate 2. By reaching the terminal position on the ejector 5, the latch component 24 is again completely pivoted inwardly, this being predefined by the interaction between the guide track 25 and the guide pin 24*a* engaging therein on the latch component 24.

If and when the drawer 53 following a discharging procedure of the force accumulator 3 is moved farther in the opening direction M1, the ejector unit 1 separates from the entrainment element 23, cancelling contact between the entrainment element 23 and the contact portion 21 of the set screw 22 (FIG. 6).

From the terminal position described above, which the ejector assumes only briefly, the ejector 5 by spring elements 33 on the base plate 2 is urged by a few millimeters in the direction P1, for example. In relation to the coil springs 10, 11 of the force accumulator 3, the spring elements 33 have a comparatively minor force. By way of the movement of the ejector 5 in the direction P1 by way of the force of the spring elements 33, a bearing portion 29 of the latch component 24 in a standby position of the ejector 5 is put in direct clearance-free contact with a mounting pin 31 of a tension lever 30 of the coupling installation 4 (FIG. 6). The mounting pin 31 is disposed on a first end of the tension lever 30 and may move freely along a, for example, linear, guide track 27 and/or a linear guide 63 which is configured on the ejector 5 for so long, and, in particular, within an opening procedure of the drawer 53, until the latch component 24 holds the mounting pin 31 and/or the tension lever 30 in direct, clearance-free contact with the ejector 5.

The standby position of the ejector 5 which is shown in FIG. 6 at the same time is also a starting position of the ejector 5 for a charging procedure of the force accumulator 3 by way of the coupling installation 4.

Besides the tension lever 30, the coupling installation 4 comprises a guide lever 34 and a connection element 35. By way of a mounting pin 36, the tension lever 30 on a second end is articulated on the guide lever 34. The connection element 35, on a second end, by way of a mounting pin 37 which is spaced apart from the mounting pin 36, is likewise articulated on the guide lever 34, and on the first end thereof, said connection element 35 by way of a further mounting pin 38 is articulated on the motion element 18. The guide lever 34 at a first end by way of a mounting pin 39 is disposed so as to be movable, in particular, pivotable, on the base plate 2. The mounting pin 39 is preferably received both on the base plate 2 as well as on the cover component 9.

A longitudinal axis A1 of the tension lever 30, which runs through the mounting pins 31, 36 of the tension lever 30, in relation to a first longitudinal axis A2 of the guide lever 34, which runs through the mounting pins 36, 39, has an angle $\alpha$.

A longitudinal axis A3 of the connection element 35, which runs through the mounting pins 37, 38 of the connection element 35, in relation to a second longitudinal axis A4 of the guide lever 34, which runs through the mounting pins 37, 39, has an angle $\beta$.

The guide lever 34 of the coupling installation 4, on a second end, comprises a lever attachment 40. A locking element 41 and a stop element 42 are configured on the lever attachment 40. The locking element 41 is designed as a spring-impinged pivotable latch.

The terminal position of the discharged state of the force accumulator 3 (FIG. 5) is, in particular, predefined by the guide lever 34 impacting on a wall portion 28 of the base plate 2, and/or by a the stop element 42 impacting on a wall portion 47 on a web-type wall 48 of the base plate 2. The wall portion 47 is formed from an annular portion of a damping element, for example. If and when the stop element 42 of the guide lever 34 following a discharging procedure of the force accumulator 3 bears on the wall portion 47, by virtue of a remaining bias of the coil springs 10, 11 a tensile force in the direction P2 is transmitted from the motion element 18 by way of the connection element 35 to the guide lever 34. By virtue of the rigid embodiment of the coupling installation 4, or by virtue of the impact of the stop element 42 on the wall portion 47, respectively, the motion element 18 is prevented from moving farther in the direction P2, wherein the force accumulator 3 by way of the motion element 18 is held free of clearance in the terminal position of the discharged state.

In particular, the stop element 42 and/or the wall portions 47, 28 may be designed so as to be elastic or damping, respectively, thus reducing or preventing an impact noise.

When tensioning the force accumulator 3, the guide lever 34 by virtue of the design thereof may transmit a force from the tension lever 30 to the connection element 35 at a geared up ratio.

The geared up transmission ratio is formed, on the one hand, by the ratio of the spacing of the mounting pins 39 and 36 in relation to the spacing of the mounting pins 39 and 37 on the guide lever 34 and, on the other hand, by the combined mutual circular and linear movement of the tension lever 30 and/or of the connection element 35 during the charging procedure of the force accumulator 4.

The elements of the coupling installation 4, by virtue of the arrangement of the former on the ejector unit 1, may move as follows:

The mounting pin 31 and thus the first end of the tension lever 30, by virtue of the mounting thereof in the guide track 27, may move exclusively parallel with a movement direction of the ejector 5, in particular, parallel with a movement direction of the movable furniture part 53.

The mounting pin 38 and thus the first end of the connection element 35, by virtue of the mounting thereof on the slide-type motion element 18 and thus advantageously in the guide contour 19, may move exclusively parallel with a movement direction of the motion element 18 or of the ejector 5, respectively, in particular, parallel with the movement direction of the movable furniture part 53.

The mounting pin 36 and thus the second end of the tension lever 30, by virtue of the mounting thereof at the second end of the guide lever 34, may move exclusively in a circular path about a rotation center of the mounting pin 39 of the guide lever 34.

The mounting pin 37 of the connection element 35 and thus the second end of the connection element 35, by virtue of the mounting thereof in a central region of the guide lever 34, may move exclusively in a circular path about a rotation center of the mounting pin 39 of the guide lever 34.

By virtue of the above-mentioned design, the coupling installation 4 may transmit at a geared up ratio a force for tensioning the force accumulator 3 from the ejector 5 by way of the tension lever 30 and of the guide lever 34 to the connection element 35 and thus to the force accumulator 3, and, in particular, the coupling installation 4 transmits the force which is exerted by the ejector 5 in a geared down ratio to the force accumulator 3. This means that a user when charging the force accumulator 3 has to apply less force to the ejector 5 than said user would have to apply when wishing to charge the force accumulator 3 without geared down ratio, or when directly pulling the end 17 of the force accumulator 3 in the direction P1, respectively.

The beginning and the end of the charging procedure of the force accumulator 3 or of the coil springs 10, 11, respectively, is visualized in FIGS. 6 and 7.

Tensioning of the force accumulator 3 is performed by a movement of the drawer 53 in the case of closing, or on a part-distance of the closing movement of the drawer 53. The starting position of the ejector unit 1, in which the latter is prepared for tensioning of the force accumulator 3 and expects a closing procedure of the drawer, is shown in FIG. 6.

If and when the drawer 53 is closed, for example, from the outside by a user, the ejector unit 1 moves in the direction M2 toward the entrainment element 23. The charging procedure of the force accumulator 3 begins as the contact portion 21 of the set screw 22 of the ejector 5 impacts on the entrainment element 23. The ejector 5, by impacting on the entrainment element 23, is moved in the direction P1, for example, by virtue of the inertia of the drawer 53 in relation to the base plate 2.

By way of the coupling of the ejector 5 to the force accumulator 3 by way of the coupling installation 4, the motion element 18 of the force accumulator 3 is likewise displaced in relation to the base plate 2 in the direction P1, and the second end 17 of the coil springs 10, 11 is displaced in the direction P1, the coil springs 10, 11 thus being elongated.

At the end of the tensioning procedure of the force accumulator 3, the ejector 5 is located in a terminal charging position, as is shown in FIG. 7. In the tensioned state of the force accumulator 3, the ejector unit 1 is located in a locked state.

In the locked state, a locking state is determined by the locking element 41 of the coupling installation 4 and by the locking member 7 which is configured as a flap, wherein a discharging movement of the coupling installation 4 is blocked by the locking member 7.

Tensioning of the force accumulator 3 is fully completed prior, for example, to an automatic retracting feature for the force-assisted retraction of the drawer 53 into the fully closed closing position on the basic furniture structure 51 becoming effective. The automatic retracting feature is not part of the ejector unit 1, and is integrated, for example, in the guide means 52 or in the part-pullout units or full-pullout units, respectively.

After the force accumulator 3 has been tensioned, the ejector 5 by virtue of bearing on the entrainment element 23 is moved in the direction P1 in relation to the base plate 2 by way of the further closing movement of the drawer 53. Herein, the operational connection between the latch component 24 of the ejector 5 and the mounting pin 31 of the tension lever 30 is cancelled. This is performed by an interaction between the guide track 25 and the guide pin 24*a* on the latch component 24, wherein the latch component 24 by the guiding of the guide pin 24*a* in the guide track 25 is pivoted away from the mounting pin 31 (FIG. 8). In this state, the ejector 5 is uncoupled from the coupling installation 4 and is displaceable so far in the direction P1, in particular, by an automatic retracting feature, until the drawer 53 is fully closed on the basic furniture structure 51, and the ejector 5 bears on the activator 6 in the basic position according to FIG. 3.

In the basic position of the ejector unit 1 according to FIG. 3, it is possible for a user to manually pull the drawer 53 in the opening direction M1 without an ejector function or without first cancelling the locking state, respectively. Herein, the force accumulator 3 of the ejector unit 1 is non-actuated or charged, respectively.

In order for the drawer 53 by way of the ejector unit 1 to be expelled from the position in which said drawer 53 is completely retracted or closed, respectively, on the basic furniture structure 51, a user has to act on the drawer while pushing from the outside in the direction M2. To this end, the ejector unit 1 has a so-called touch-latch function which knows a locked state which is unlockable in that the drawer 53 which is closed and retracted on the basic furniture structure 51 is moved in the closing direction M2. This closing movement, or inwardly pushing of the drawer 53 in the direction M2, respectively, is performed until a stop position corresponding to a front gap which in the closed state of the drawer 53, is predefined, in particular, by way of a spacing between an internal side of the drawer front 55 and a forward end side or the side walls 56 of the basic furniture structure 51, respectively, is reached. The front gap is typically a few millimeters, for example, approx. 1 to 10 millimeters.

Accordingly, unlocking of the ejector unit 1 is adapted in such a manner that a closing movement of the drawer 53 in the direction M2 of a few millimeters, or at maximum by the value of the front gap, respectively, is sufficient for unlocking and thus the force-assisted ejection of the drawer 53 to be reliably predefined.

Proceeding from the basic position according to FIG. 3, the ejector unit 1 together with the drawer 53 is moved in the direction M2. Since the set screw 22 bears on the entrainment element 23, the ejector 5 is moved in relation to the base plate 2 in the direction P1, a contact portion 44 on the ejector 5 thus pressing against the activator 6, accordingly pushing the latter in the direction P1. The activator 6 is present on the base plate 2 so as to be linearly displaceable in a limited manner, typically by a few millimeters or by less than the dimension of the front gap, respectively, in the directions P1 and P2.

The activator 6 is preferably directly coupled to the locking member 7 which is designed as a flap 43 in such a manner that the linear activation movement of the activator 6 in the direction P1 sets the flap 43 in rotary motion about a pivot axis D. The flap 43 by the rotating movement is released from a locking position into which the flap 43 is urged by a spring member which is configured as a leaf spring 49. In the locked state of the ejector unit 1, the flap 43 which is located in the locking position blocks the guide lever 34 or the lever attachment 40, respectively, in such a manner that the force accumulator 3 remains in the charged state thereof.

Blocking of the guide lever 34 is cancelled by the rotating movement of the flap 43. The locking element 41 on the lever attachment 40, which is biased by a leg spring 60, hereby preferably pivots out.

The locking element 41, which projects from the lever attachment 40, moves conjointly with the pivoting procedure of the guide lever 34 below the flap 43, past the latter, and continues without interruption the rotating movement of the flap 43, initiated by the activator 6, about the pivot axis D. On account thereof, a rotation angle of the flap 43 out of the locking position is advantageously enlarged. The ejector unit 1 is reliably unlocked by the movement of the lever attachment 40 below and past the flap 43 and continued by the outwardly pivoting locking element 41. To this end, a comparatively very minor linear activation movement of the activator 6 in the direction P1 is advantageously required. Subsequently, the cap 43 by the leaf spring 49 is urged back into the locking position of the former.

The locking element 41 which is present so as to be outwardly pivoted on the lever attachment 40 is again brought to bear on a front edge of the flap 43 when the force accumulator 3 is tensioned. Herein, the locking element 41 yields counter to the spring force of the leg spring 60, such that said locking element 41 is retracted so far on a periphery of the lever attachment 40 that the guide lever 34 by way of the lever attachment 40 can pivot past the flap 43.

Behind the flap 43, the locking element 41 is outwardly pivoted again by the spring force of the leg spring 60. Following the tensioning procedure, the guide lever 34 by way of the projecting locking element 41 is pushed against the flap 43 which is held by the leaf spring 49 so as to lock, the force accumulator 3 thus being in the locked state.

The rotating movement of the flap 43 of the ejector unit 1, or of the device 58, respectively, is transmitted by a synchronizer bar 61 which is disposed so as to be rotationally fixed on the flap 43 to a second device 62 which is advantageously of identical action and which is disposed on the drawer 53.

The synchronizer bar 61 advantageously connects the locking member 7 to a second locking member which is present on the second device 62. The two locking members are thus directly and/or synchronously coupled in terms of motion. This represents a synchronizing principle which is contrary to a physical connection between actuator elements of two ejector units on one furniture part.

Figure 10:
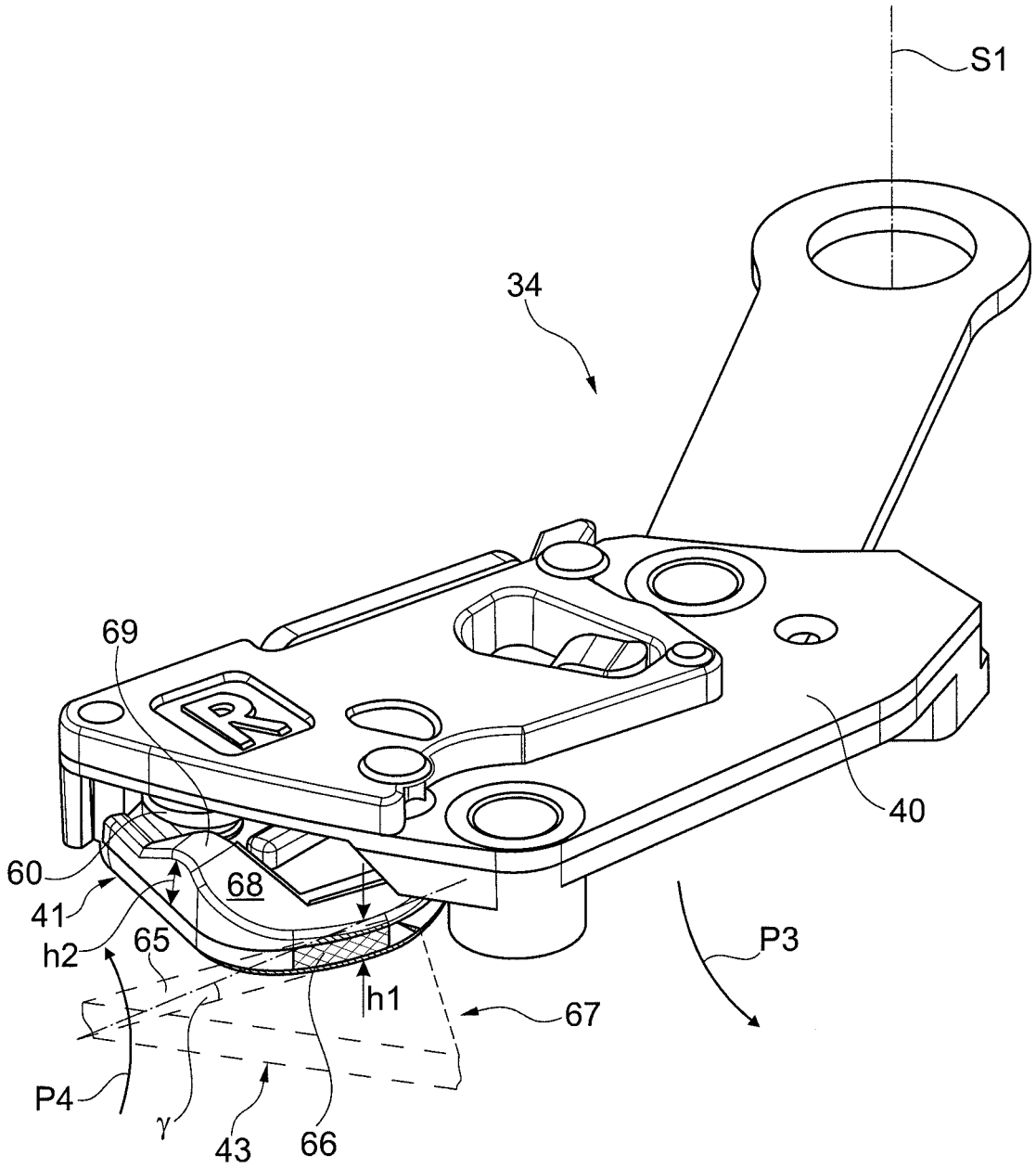
FIG. 10 in a perspective and enlarged manner shows a guide lever in the state according to FIG. 3, wherein an outline of part of a locking member is indicated by dashed lines.

FIG. 10 in a perspective manner shows the guide lever 34 having the lever attachment 40 and the locking element 41 having the leg spring 60 in an enlarged manner, wherein an outline of part of a wing-type appendage 67, acting in a locking manner, of the flap 43 is indicated being in the locking state or in bearing contact with the locking element 41 according to the state of FIG. 3, respectively.

The flap 43 which by way of the leaf spring 49 is urged to the locking state locks the guide lever 34 in relation to a pivoting movement of the guide lever 34 in the direction P3 about the pivot axis Si of the guide lever 34. Under the action of the force accumulator 3 which is in the tensioned state, the guide lever 34 is biased in the direction P3. Herein, the locking flap 43 by way of part of a peripheral narrow side 65 of the appendage 67 forms a mechanical stop for a narrow end-side portion 66 on the locking element 41. The portion 66 in FIG. 10 is highlighted with hatched lines.

Figure 11:
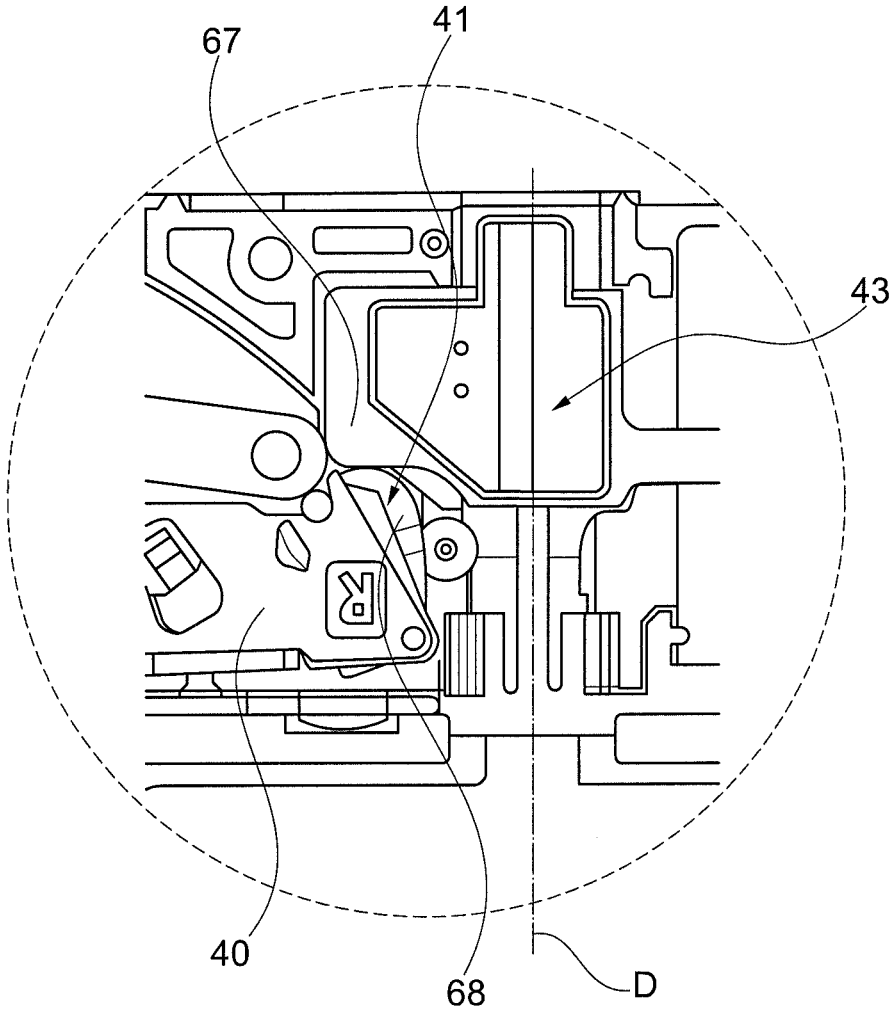
FIG. 11 shows an enlarged fragment according to the region K1 of FIG. 3.

FIG. 11 shows this state according to FIG. 3. When the flap 43, following an actuation procedure, is upwardly pivoted about the axis D in the direction P4 and the locking state is thus cancelled in that the narrow side 65 by way of the flap 43 is moved away from the portion 66, the guide lever 34 pivots in the direction P3, the force-assisted opening movement of the drawer 53 being thus performed.

Pivoting the flap 43 from the locked position in the direction P4 in relation to the respective part of the narrow side 65 on the portion 66, is performed by a few angular degrees, for example, by 5 to 10 angular degrees, or by the angle gamma, respectively, or γ, respectively, this depending on the height dimension h1 of the portion 66 of approx. 1 millimeter, for example. The height of the narrow side 65 preferably corresponds to at least approximately the height h1. Following upward pivoting of the flap 43 in the direction P4 about the angle γ, the locking element 41 moves past below the appendage 67, wherein, under participation of the leaf spring 49 which urges the flap 43 counter to the direction P4, a lower side of the appendage 67 is supported on an upper side of the locking element 41. The upper side of the locking element 41 which on the lower side acts on the appendage 67, has an obliquely aligned support portion 68 such that the flap 43, in a corresponding manner to the obliqueness of the support portion 68, is further lifted in the direction P4. The obliqueness of the drive portion 68, counter to the direction P3, increases from the portion 66 up to a crest 69 at the top of the locking element 41. Further lifting of the flap 43 by the locking element 41 is performed over the height h2, according to the height of the support portion 68, or further upward pivoting is preferably performed about a pivoted distance in the range of the angle γ or about somewhat more than the latter, respectively. The flap 43 is thus pivoted in the direction P4 by at least 2*γ.

When the guide lever 34, or the locking element 41, respectively, has been pivoted past the flap 43 or the appendage 67, respectively, the flap 43 is returned under the resistance of the leaf spring 49 from the pivoted position in which the latter is pivoted to the maximum in the direction P4, or is lifted to the maximum, respectively, to the locking position according to FIG. 10 or 11, respectively. The locking element 41 which by way of the leg spring 60 has been moved to the position according to FIG. 10, in which said locking element 41 in relation to a periphery of the lever attachment 40 is protruding, by way of bearing on a web step 70 which runs in a curved manner on the base plate 2 (cf. FIG. 3), during further pivoting in the direction P3 is pushed inward such that the locking element 41 still projects from the lever attachment 40 only to a minor extent. The retreated position of the locking element 41 is maintained by the continuous configuration of the web step 70 across the entire subsequent pivoting path of the guide lever 34 in the direction P3, and during later pivoting back of the guide lever 34 in the direction counter to P3 when tensioning the force accumulator 3, until the locking element 41 passes the appendage 67 and behind the latter, under the action of the leg spring 60, again pivots to the locking position according to FIG. 3 or 11, respectively, and the guide lever 34 in the direction P3 is blocked by the narrow side 65.

Figure 12:
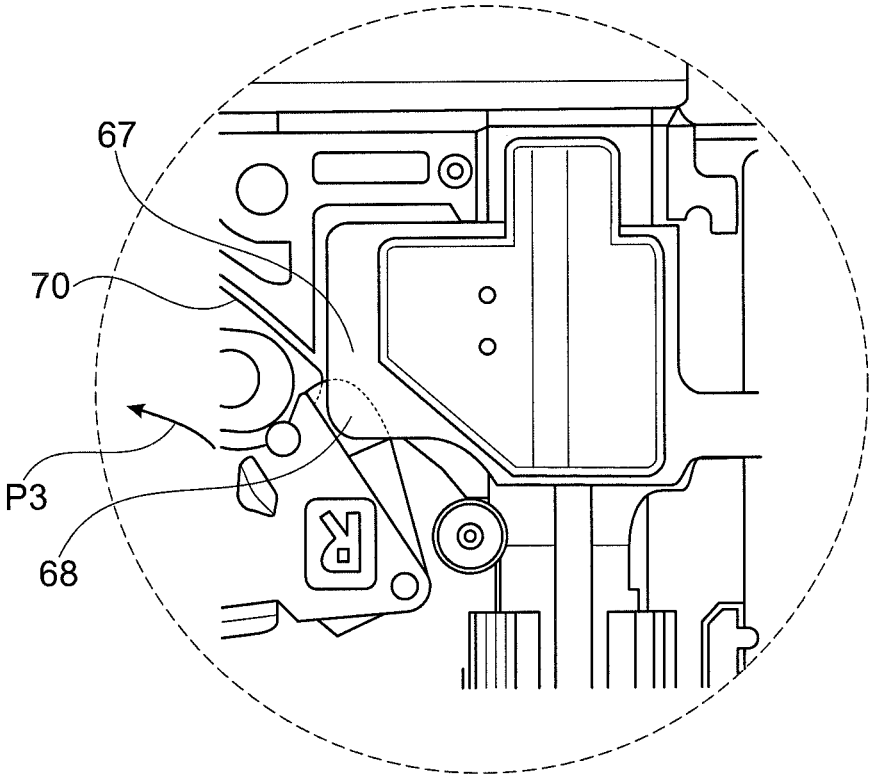
FIG. 12 shows an enlarged fragment according to the region K2 of FIG. 4.

FIG. 12 relates to the moment when the flap 43 by means of the locking element 41 is underridden or lifted, respectively, shortly after the locking position of the guide lever 34 has been unlocked. The outline of the locking element 41 below the appendage 67 is indicated with dashed lines.

By way of a rotating movement of the flap 43 about the rotation axis D, for example, in the case of unlocking as has been described above, by way of the plug-fitted synchronizer bar 61 of which the longitudinal axis coincides with the rotation axis D, a torque is transmitted in a synchronized manner from the flap 43 of the device 58 to the synchronizer bar 61 and onward to a function unit which is present at the other end of the synchronizer bar 61 and optionally to a locking member or a flap, respectively, of a twin device 62 (cf. FIGS. 1 and 2).

LIST OF REFERENCE SIGNS

1 Ejector unit
2 Base plate
3 Force accumulator
4 Coupling installation
5 Ejector
6 Activator
7 Locking member
8 Front-gap adjustment assembly
9 Cover component
10 Coil spring
11 Coil spring
12 End
13 Fixed mounting
14 Mounting part
15 Set part
16 Operating portion
17 End
18 Motion element
19 Guide contour
20 Linear guide
21 Contact portion
22 Set screw
23 Entrainment element
24 Latch component
**24*a*** Guide pin
25 Guide track
26 Stop element
27 Guide track
28 Wall portion
29 Bearing portion
30 Tension lever
31 Mounting pin
32 Retaining member
33 Spring element
34 Guide lever
35 Connection element
36-39 Mounting pin
40 Lever attachment
41 Locking element
42 Stop element
43 Flap
44 Contact portion
45 Housing
46 Operating portion
47 Wall portion
48 Wall
49 Leaf spring
50 Item of furniture
51 Basic furniture structure
52 Guide means
53 Drawer
54 Drawer base
55 Drawer front
56 Side wall

57 Rear drawer wall
58 Device
59 Basic structure side wall
60 Leg spring
61 Synchronizer bar
62 Device
63 Linear guide
64 Counter portion
65 Narrow side
66 Portion
67 Appendage
68 Support portion
69 Crest
70 Web step

The invention claimed is:

1. A device for moving a movable furniture part in an opening direction of the furniture part in relation to a basic furniture structure of an item of furniture, wherein the movable furniture part by way of guide means is capable of being put in the opening direction and in a closing direction which is counter to the opening direction, wherein the device comprises a force accumulator such that by way of the fitted device the movable furniture part under action of the force accumulator is capable of being put in the opening direction, and wherein the device has a locking assembly for locking a tensioned position of the force accumulator, in which the force accumulator is charged for the opening movement of the furniture part), wherein the tensioned position is unlockable, wherein a locking member of the locking assembly, and a movable lever of the device, which is coupled to the force accumulator, are present in an interacting manner such that in the locked tensioned position of the force accumulator, the locking member assumes a locking position, and the lever assumes a standby position in which cancelling of the standby position of the lever is blocked by the locking member.

2. The device according to claim 1, wherein the lever has an adjustable contact portion which in the standby position of the lever assumes a blocked state and comes to bear on the locking member.

3. The device according to claim 1, wherein the locking member is movably mounted and is in particular pivotable.

4. The device according to claim 1, wherein the locking member is biased.

5. The device according to claim 2, wherein the contact portion is mounted so as to be capable of yielding from the blocked state.

6. The device according to claim 2, wherein the contact portion is impinged by a spring.

7. The device according to claim 2, wherein the contact portion is designed on a pivotable latch.

8. The device according to claim 1, wherein the locking member and the lever are adapted in such a manner that a departure from the locking position of the locking member is a precondition to the standby position of the lever being capable of being cancelled.

9. The device according to claim 2, wherein the locking member and a support portion on the lever are adapted in such a manner that upon departing from the locking position of the locking member, the support portion acts on the locking member, wherein the locking member moves away from the locking position.

10. The device according to claim 2, wherein the contact portion and the support portion are designed on a common component on the lever.

11. The device according to claim 1, wherein the locking member and the lever are mutually adapted such that the lever in the case of the force accumulator being tensioned is movable past the locking member, wherein the lever is capable of being put in the standby position.

12. An item of furniture having a basic furniture structure and a movable furniture part which by way of guide means in relation to the basic furniture structure is movable in an opening direction of the furniture part and in a closing direction which is counter to the opening direction, wherein a device according to claim 1 is provided.

* * * * *